US009486048B2

(12) United States Patent
Yu

(10) Patent No.: US 9,486,048 B2
(45) Date of Patent: Nov. 8, 2016

(54) HAIR STYLING DEVICE

(71) Applicant: KONINKLIJKE PHILIPS N.V., Eindhoven (NL)

(72) Inventor: Wai Kong Yu, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/433,943

(22) PCT Filed: Jul. 8, 2014

(86) PCT No.: PCT/EP2014/064605

§ 371 (c)(1),
(2) Date: Apr. 7, 2015

(87) PCT Pub. No.: WO2015/010892

PCT Pub. Date: Jan. 29, 2015

(65) Prior Publication Data

US 2016/0135565 A1 May 19, 2016

(30) Foreign Application Priority Data

Jul. 24, 2013 (EP) ..... 13177748

(51) Int. Cl.

| | |
|---|---|
| ***A45D 1/28*** | (2006.01) |
| ***A45D 2/00*** | (2006.01) |
| ***A45D 6/20*** | (2006.01) |
| ***A45D 19/16*** | (2006.01) |

(52) U.S. Cl.

CPC ..... *A45D 1/28* (2013.01); *A45D 2/001* (2013.01); *A45D 6/20* (2013.01); *A45D 19/16* (2013.01); *A45D 2200/155* (2013.01)

(58) Field of Classification Search

CPC ..... A45D 1/04; A45D 1/06; A45D 1/08; A45D 1/28; A45D 2/001; A45D 2002/003

USPC ..... 132/221, 223, 227, 229, 263, 269, 271, 132/272; 219/222, 225

See application file for complete search history.

(56) References Cited

U.S. PATENT DOCUMENTS

| | | | | |
|---|---|---|---|---|
| 2002/0036000 | A1* | 3/2002 | Hirata | A45D 1/00 132/224 |
| 2008/0041408 | A1* | 2/2008 | Shepherd | A45D 1/04 132/224 |
| 2009/0188516 | A1 | 7/2009 | Catini | |
| 2011/0015463 | A1* | 1/2011 | Legendre | A45D 40/00 600/9 |
| 2011/0253164 | A1* | 10/2011 | Morgandi | A45D 1/28 132/211 |
| 2012/0017932 | A1* | 1/2012 | Takehana | A45D 1/04 132/211 |
| 2012/0227758 | A1* | 9/2012 | Ford | A45D 1/04 132/211 |
| 2012/0272993 | A1 | 11/2012 | Fereyre | |

(Continued)

FOREIGN PATENT DOCUMENTS

| | | | |
|---|---|---|---|
| JP | 04280762 | A | 10/1992 |
| WO | 2004002262 | A1 | 1/2004 |
| WO | 2012174168 | A2 | 12/2012 |

*Primary Examiner* — Tatiana Nobrega

(57) ABSTRACT

In a hair styling device comprising a heating unit (11), and a unit capable of engaging a detachable holder (21) with a hair treatment agent, whereby in the presence of the detachable holder (21), the detachable holder (21) covers the heating unit (11), a detector detects the presence of the detachable holder (21), and a temperature of the heating unit (11) in the presence of the detachable holder (21) is automatically set higher than a corresponding temperature in the absence of the detachable holder (21).

4 Claims, 2 Drawing Sheets

(56) References Cited
U.S. PATENT DOCUMENTS

2012/0312320 A1* 12/2012 Humphreys ..... A45D 1/04
132/211

2013/0213431 A1* 8/2013 Geva ..... A45D 34/04
132/320

* cited by examiner

HAIR STYLING DEVICE

FIELD OF THE INVENTION

The invention relates to a hair styling device.

This application is the U.S. National Phase application under 35 U.S.C. §371 of International Application No. PCT/EP2014/064605, filed on Jul. 8, 2014, which claims the benefit of European Application No. 13177748.4 filed on Jul. 24, 2013. These applications are hereby incorporated by reference herein.

BACKGROUND OF THE INVENTION

U.S. 2012/0017932 discloses that in a hair styling device having a detachable holder with a hair treatment agent, a heating temperature can preferably be changed in accordance with the hair treatment agent for use. According to such a constitution, an applying temperature (the heating temperature) can preferably be regulated in accordance with the hair treatment agent for use, the properties of the hair treatment agent-holder and the state of the hair to be styled.

SUMMARY OF THE INVENTION

It is, inter alia, an object of the invention to provide an improved hair styling device. The invention is defined by the independent claims. Advantageous embodiments are defined in the dependent claims.

In a hair styling device comprising a heating unit, and a unit capable of engaging a detachable holder with a hair treatment agent, whereby in the presence of the detachable holder (21), the detachable holder (21) covers the heating unit (11), a detector detects the presence of the detachable holder, and a temperature of the heating unit in the presence of the detachable holder is automatically set higher than a corresponding temperature in the absence of the detachable holder.

The hair styling device of the present invention has an extended function where an accessory, i.e. a detachable holder with a hair treatment agent e.g. in the form of a sleeve, can be attached to the heating plate. The sleeve contains active ingredients that will be released to the hair during the straightening of hair. To obtain the function of ingredients/oil release, a higher temperature than necessary for a normal straightener operation is needed, and as a result of the present invention, consumers do not need to change the temperature themselves as the invention allows for an automatic higher temperature setting when the presence of a sleeve is detected.

These and other aspects of the invention will be apparent from and elucidated with reference to the embodiments described hereinafter.

DESCRIPTION OF EMBODIMENTS

Figure 1:
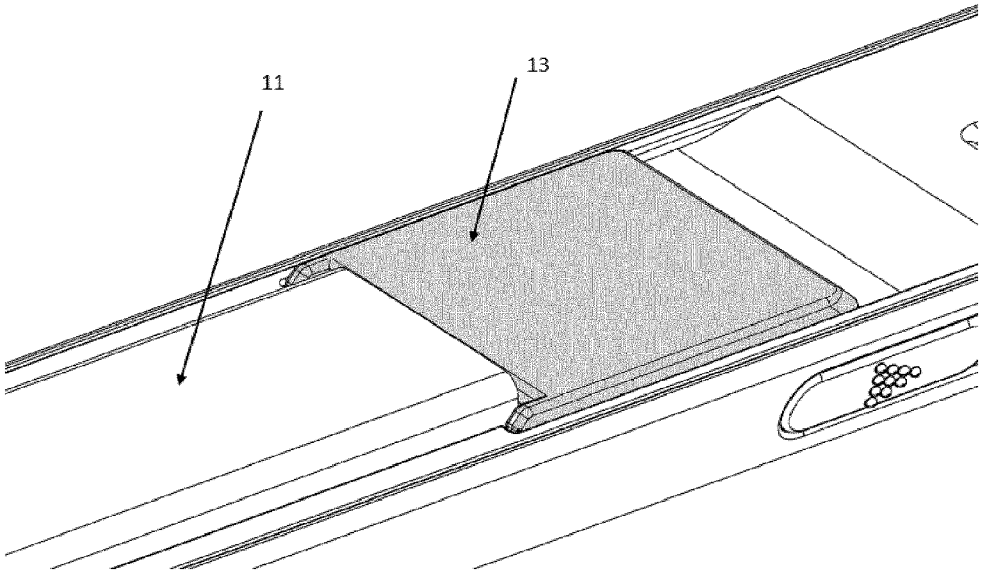
FIGS. 1-4 show a jaw of a hair styling device in accordance with an embodiment of the present invention.

FIG. 1 shows a jaw of a hair styling device (e.g. a hair straightener or hair iron) in accordance with an embodiment of the present invention, with a heating plate 11 and a sleeve sliding cover 13.

Figure 2:
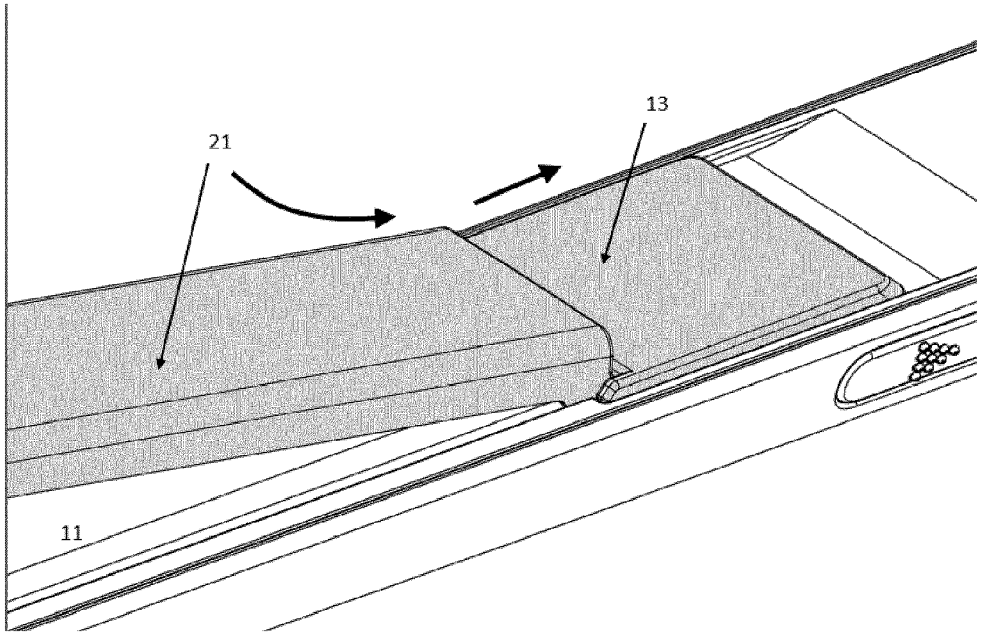

FIG. 2 shows how a detachable holder with a hair treatment agent in the form of a sleeve 21 is mounted on the jaw of FIG. 1. When the sleeve 21 is installed, the sleeve sliding cover 13 moves backward.

Figure 3:
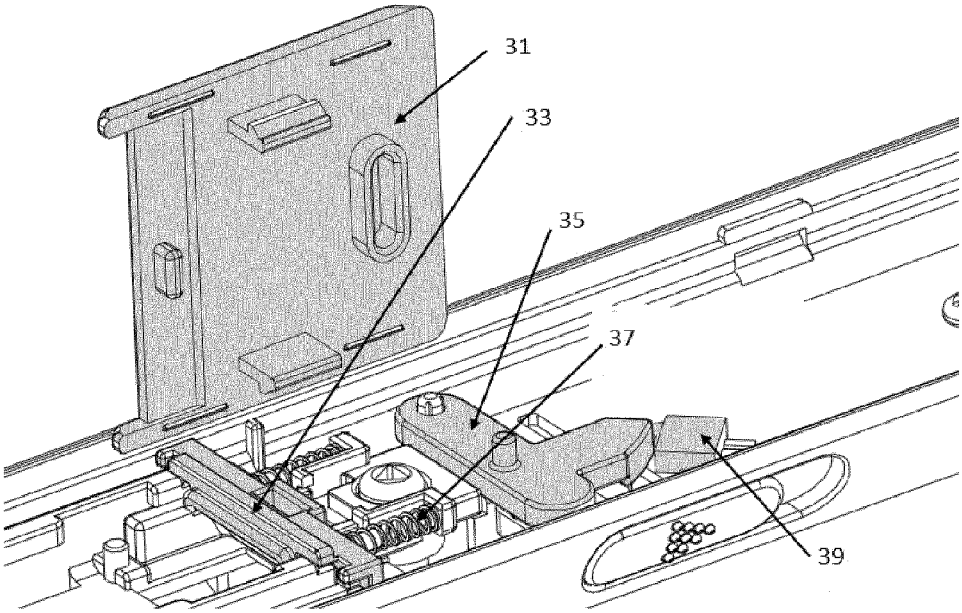
Figure 4:
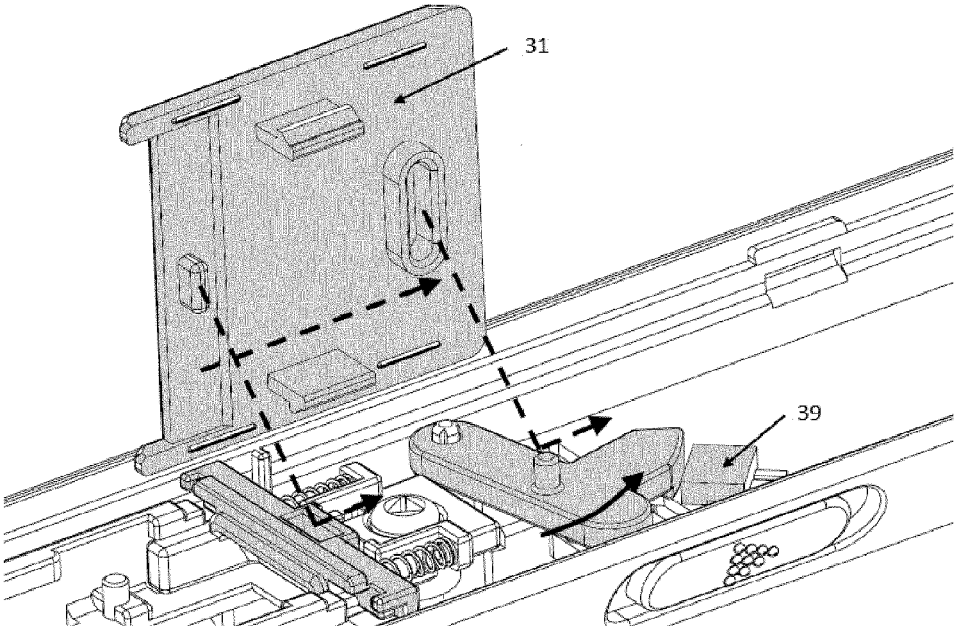

FIGS. 3 and 4 show the inside of the jaw of FIG. 1. Reference sign 31 indicates the downside of the sleeve sliding cover 13. A sleeve release bracket 33 engages with compression springs 37, which are pushed backward when the sleeve 21 is installed. The sleeve release bracket thus acts as a unit 33 capable of engaging the detachable holder 21 with a hair treatment agent. A lever 35 engages with a switch 39, which acts as a detector for detecting the presence of the sleeve 21. The sleeve sliding cover 13/31 is an interface between the sleeve release bracket 33 and the lever 35, so that when the sleeve release bracket 33 moves to the right when the sleeve 21 is installed, so does the lever 35, thereby engaging the switch 39. In this way, the hair styling device can detect if a sleeve 21 is installed, which triggers a change of the temperature setting of the heating plate 11.

Thus, when a sleeve 21 is installed, the sleeve 21 will push the release bracket 33 and sliding cover 13 backward, a lever 37 inside will be driven by the sliding cover 13 and swings a certain angle travel which will trigger a detect switch 39. The detect switch 39 will send a signal to a processor which sets the hair styling device to a higher temperature setting.

When the sleeve 21 is uninstalled, the release bracket 33, sliding cover 13 and lever 35 will return to their original positions by the retaining force of the compression springs 37, and the temperature setting(s) of the hair styling device will return to the normal mode.

While FIGS. 1-4 show only one leg of a hair straightener, both legs may be equipped with a sleeve. In an embodiment, the hair styling device has an indicator, e.g. a LED or a display, for indicating the increased temperature setting in the presence of the sleeve.

In one example, the temperature setting in the presence of the sleeve is at least 10 degrees Celsius higher than in the absence of the sleeve 21. For example, instead of 190° C., it is 210° C.

In another example, a user may select between 3 different temperature settings. Then, in the presence of the sleeve 21, each of these temperature settings would be 20 degrees Celsius higher, e.g. as follows:

| Temperature setting by user | Temperature without sleeve | Temperature with sleeve |
|---|---|---|
| Low | 180° C. | 200° C. |
| Mid | 190° C. | 210° C. |
| High | 200° C. | 220° C. |

It should be noted that the above-mentioned embodiments illustrate rather than limit the invention, and that those skilled in the art will be able to design many alternative embodiments without departing from the scope of the appended claims. For example, in an alternative embodiment, the switch 39 could be directly engaged by the sleeve release bracket 33; the lever 39 in the shown embodiments has the advantage that it allows for a magnified movement. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements, and/or by means of a suitably programmed processor. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A hair styling device comprising:

an elongated styling jaw defining a longitudinal axis, the styling jaw comprising a heating plate arranged in a distal portion and a sliding cover adjacent to the heating plate, the sliding cover being coupled to a release bracket in an interior portion of the styling jaw, wherein the release bracket is operatively coupled to a switch configured to modify a preset temperature setting of the heating plate;

a detachable holder with a hair treatment agent removably coupled to the styling jaw and configured to cover the heating plate;

wherein the sliding cover and the release bracket are configured to slide together along the longitudinal direction between first and second positions which define disengaged and engaged positions of the switch, respectively, wherein when the detachable holder is not coupled to the styling jaw, the sliding cover and the release bracket are provided in the first position, whereby the switch is disengaged, and wherein when the detachable holder is coupled to the styling jaw, the sliding cover and the release bracket are provided in the second position, whereby the switch is engaged to change the temperature setting of the heating plate to a higher temperature than the preset temperature setting.

2. A hair styling device as claimed in claim 1, wherein the temperature setting of the heating plate in the presence of the detachable holder is at least 10 degrees Celsius higher than the corresponding temperature setting in the absence of the detachable holder.

3. A hair styling device as claimed in claim 1, wherein the temperature setting of the heating plate in the presence of the detachable holder is 20 degrees Celsius higher than the corresponding temperature setting in the absence of the detachable holder.

4. A hair styling device as claimed in claim 1, wherein the temperature setting is selectable by a user, and each temperature setting of the heating plate in the presence of the detachable holder is higher than the corresponding temperature setting in the absence of the detachable holder.

* * * * *